US005713058A

United States Patent [19]

Rider

[11] Patent Number: 5,713,058

[45] Date of Patent: Jan. 27, 1998

[54] PROCESSING OF PHOTOGRAPHIC MATERIALS

[75] Inventor: Christopher Barrie Rider, New Malden, England

[73] Assignee: Eastman Kodak Company, Rochester, N.Y.

[21] Appl. No.: 642,731

[22] Filed: May 3, 1996

[30] Foreign Application Priority Data

May 4, 1995 [GB] United Kingdom ..... 9509117

[51] Int. Cl.[6] ..... G03D 3/02

[52] U.S. Cl. ..... 396/626

[58] Field of Search ..... 396/630, 622, 396/626

[56] References Cited

U.S. PATENT DOCUMENTS

| | | | |
|---|---|---|---|
| 3,192,846 | 7/1965 | Wright . | |
| 3,344,729 | 10/1967 | Kitrosser . | |
| 3,516,345 | 6/1970 | Meyer . | |
| 3,610,131 | 10/1971 | Frick et al. . | |
| 3,688,677 | 9/1972 | Frick et al. | 396/626 |
| 3,774,521 | 11/1973 | Beck | 396/626 |
| 4,359,279 | 11/1982 | Popoff | 396/627 |
| 4,989,028 | 1/1991 | Hall et al. | 396/630 |
| 5,055,381 | 10/1991 | Abe et al. | 430/398 |
| 5,136,323 | 8/1992 | Frank et al. | 396/626 |
| 5,172,153 | 12/1992 | Frank et al. | 396/626 |
| 5,177,522 | 1/1993 | Hayashi | 396/626 |
| 5,239,327 | 8/1993 | Frank | 396/626 |
| 5,289,224 | 2/1994 | Devaney, Jr. et al. | 396/626 |
| 5,298,371 | 3/1994 | Nakamura | 430/400 X |
| 5,380,627 | 1/1995 | Grimsey | 396/626 |

OTHER PUBLICATIONS

Photog. Sci. & Eng., vo. 19, Mar./Apr. 1975, A. Green, "Some Aspects of Fixing and Washing".

*Primary Examiner*—D. Rutledge
*Attorney, Agent, or Firm*—Frank Pincelli

[57] ABSTRACT

In conventional processing of photographic material, agitation of processing solution in a processing tank associated with a particular processing stage is achieved by withdrawing processing solution from and pumping the same solution back into the tank. It has been recognised that, especially for the fixing and washing stages, solution flow across the material surface has greater effect on diffusion rates of chemicals into and out of the photographic material when it occurs during the latter stages of the time that the material remains in a particular processing solution.

3 Claims, 2 Drawing Sheets

PROCESSING OF PHOTOGRAPHIC MATERIALS

FIELD OF THE INVENTION

The present invention relates to the processing of photographic materials and is more particularly concerned with a method of increasing the rate of processing by means of improved agitation of the processing solutions.

BACKGROUND OF THE INVENTION

Recirculation systems are mainly employed in processing tanks which are used for processing photographic materials to ensure uniformity of temperature and chemical concentration throughout the tank. To some extent, recirculation also increases mass transport of chemical components both into and out of the photosensitive surface of the material being processed by providing extra solution flow across the photosensitive surface.

Generally, the recirculation system of a photographic processor operates by withdrawing solution through an exit orifice from one location in a processing tank and pumping it back into the same tank at another location through a supply orifice.

In some tanks, the exit orifice may comprise a series of apertures across the width of the material. In other arrangements, it may be a single pipe aimed at some kind of spreader bar to gain uniformity across the material.

However, this may not always be the case, and provided the whole of the processing solution is well mixed, it does not generally matter if some parts of the tank away from the photosensitive surface of the material reach equilibrium faster than others. The effectiveness of a recirculation system can be determined by measuring the uniformity of solution temperature in different parts of the processing tank. As a simple accurate measurement, this shows whether recirculation is sufficient, since temperature and chemical concentration profiles follow the same laws of diffusion. Measuring the effectiveness of the recirculation system at the photosensitive surface of the material being processed is, however, much more difficult.

It is known to agitate the processing solutions to enhance the results achieved during processing of photographic materials.

During processing of a material having a photosensitive surface, a boundary layer is formed adjacent to the photosensitive surface. In this boundary layer, there will be a depletion of fresh processing chemistry and an excess of reaction by-products which are produced during the chemical reactions which occur during processing of the material. For example, in the developer stage, there will be a depletion in the concentration of developing agent in the processing solution in the boundary layer, that is, immediately adjacent to the photosensitive surface, when compared to the concentration of the same agent in the rest of the solution. There will also be an increase in the concentration of halide ions due to their release inside the material during the development reactions and subsequent diffusion out of the material.

If the boundary layer becomes severely depleted of developing agent, the development process will suffer, especially in short process cycles. Similarly, if the build up of halide ions reaches excessive proportions, it will severely slow down the further diffusion of halide ions out of the photosensitive surface, and in some situations, can inhibit development.

Agitation systems are therefore used to keep the boundary layer as thin as possible to facilitate mass transport into and out of the photosensitive surface of the material being processed. Unlike the recirculation system, where the function is to provide overall uniformity through the processing tank, the agitation system must act at the surface of the photographic material and so remove the by-products produced which diffuse out of the photosensitive surface as well as supplying fresh processing chemistry thereto. Moreover, the agitation system tends to act across the surface of the material being processed in a direction which is generally transverse to the direction of transport of the photographic material through the processor so as to provide an even effect across the width of the material.

Agitation can be provided both by physical methods of removing the chemical boundary layer, such as rollers or wipers, and by flow techniques such as jets, sprays, solution flow and by the simple movement of the photographic material through the liquid. It will be evident that movement of the liquid across the photographic material produced by the recirculation system will also provide some agitation.

Agitation of processing solutions can be achieved by using jets to inject the processing solution into a processing path along which the material being processed travels. The processing path may be provided in a processing tank or may be defined by parallel plates in which apertures or orifices are formed through which the solution is injected into the processing path.

U.S. Pat. No. 3,192,846 and U.S. Pat. No. 3,774,521 both disclose the use of jets to provide agitation. In U.S. Pat. No. 3,192,846, the jets are also used to supply fluid layers to the material being processed which act as liquid bearings to prevent damage occurring during processing. Other types of liquid bearings and fluid suspension are described in U.S. Pat. No. 4,989,028 and U.S. Pat. No. 5,239,327.

Jets are also employed in the arrangements described in U.S. Pat. No. 4,359,279, U.S. Pat. No. 3,688,677, U.S. Pat. No. 3,610,131, U.S. Pat. No. 3,344,729 and U.S. Pat. No. 3,516,345.

It is also known to utilise jets to transport material through a processing tank. EP-A-0 558 557 discloses such an arrangement. Material to be processed is transported through a narrow elongate processing tank by means of processing solution which is directed into the tank by means of high speed jets. The jets have two functions, namely, to drive the material through the tank and to supply processing solution to the tank simultaneously.

Parallel plate or 'slot' processors are also known in which jets are used to introduce processing solution into the processing path. Such processors are described in U.S. Pat. No. 5,136,323, U.S. Pat. No. 5,172,153 and U.S. Pat. No. 5,289,224. In each of these documents, a pair of parallel plates are supported in spaced relationship to define a web channel or recess. The plates are provided with a plurality of juxtaposed transverse solution injection slits and a plurality of juxtaposed transverse evacuation slits along the length of the web channel or recess. The injection slits and evacuation slits are placed in an alternating pattern such that each injection slit is located between two evacuation slits.

When solution under pressure is supplied to the injection slits, it will flow in opposite directions from each injection slit to the adjacent evacuation slits where it will be evacuated from the channel or recess and recirculated back into the injection slits with or without replenishment as desired. The injection slits are spaced from the evacuation slits by a distance such that the solution is evacuated when its boundary layer reaches a predetermined thickness. This can be used to maintain a chemical mass transfer rate from the solution to the material being processed which is greater than that in the material itself.

When photographic material moves from one processing tank to the next during processing thereof, seasoned chemical concentrations in the baths of the two processing tanks will normally be different. Since it is concentration gradient which drives mass transport, the difference in bulk concentration between the two solutions will be all that is needed to move chemical components into and out of the photographic material in the period just after it enters the second solution. This will happen regardless of any solution flow across the material provided by agitation.

Moreover, as a photographic material passes from one processing solution into another where the ionic strengths of the two solutions are not the same, the photosensitive surface or layer of the material undergoes a change in swell. In the developer stage, the material enters the processing tank dry. The photosensitive surface or layer swells during the first few seconds of immersion in the developer solution. This effect dominates the mass transport of chemical components into the material. Similarly, when the photographic material moves from the developer stage to the fixing stage, the higher ionic strength of the fixing solution causes a swell reduction in the photosensitive layer although during the course of the fixing reaction it is possible that the rapid consumption of free fixing agent within the material can cause a temporary swelling to occur as the internal ionic strength is reduced. These effects are discussed in *Photog. Sci. & Eng, Vol* 19, *March/April* 1975, *A Green, "Some Aspects of Fixing and Washing"*.

Swell changes have a significant effect on mass transport into and out of the photosensitive layer.

Once the swell of the photosensitive layer has stopped changing, solution agitation becomes the dominant factor in driving mass transport again.

For example in the fixing stage, fixing agent diffuses into the photosensitive surface or layer and reacts with silver halide to produce a soluble complex of silver and free halide ions. The silver complex then diffuses out of the photosensitive surface or layer. Fixing is an example of a photographic processing chemical reaction which proceeds to completion. All remaining undeveloped silver is solubilized by the fixing agent. Since the reaction proceeds to completion, it does not matter that the reaction rates are uniform across the width of the material being processed. Once the reaction has occurred, it is important to remove the reaction by-products, in this case, soluble silver and halide ions, whilst it remains in that processing tank.

Problem to be solved by the Invention

In photographic processes where the processing time is short, equilibrium between the chemistry in each stage and the material being processed may not be attained. This is a particular problem in the fixing stage and its effect on subsequent stages, that is, the washing stages.

In order to minimise the load on the washing stages of a photographic processor, it is important to remove the silver complexes from the photosensitive surface or layer of the material while it is still in the fixing solution. If a significant proportion of fixed silver is carried out of the fixing solution and into the wash stage due to short fixing times, a higher wash replenishment rate will be needed. This results in a corresponding waste of wash solution.

This is generally true for all processing stages where it is desired to remove the reaction by-products from the material before it leaves that particular stage.

SUMMARY OF THE INVENTION

It is therefore an object of the present invention to provide a method for improving mass transport into and out of the photosensitive surface of a material for a given solution flow rate across the material surface.

It is another object of the present invention to provide improved agitation of processing solutions in photographic processing apparatus to decrease the amount of reaction by-products carried over from one processing stage to another.

In accordance with one aspect of the present invention, there is provided a method for processing photographic materials in apparatus having at least two processing stages, at least one processing stage comprising a processing tank having a processing path extending therethrough and an external filtration system connected thereto, the filtration system being connected between an outlet port and an inlet port provided in the processing tank, characterized in that the inlet port is located at a position within the last half of the processing path within the processing tank.

Preferably, the inlet port is located at a position within the last third of the processing path in the processing tank.

Advantageous Effect of the Invention

It is now evident that agitation, as a given solution flow across the photosensitive surface or layer of a material being processed, has a much greater effect when the majority of swelling in that surface or layer is complete.

Furthermore, in the case of fixing and bleach-fixing stages, a key part of the process is the removal of reaction by-products from the photosensitive surface or layer. Increased agitation is particularly effective towards the latter part of the submersion time in those processing solutions, that is, when the reaction by-products will start to leave the photosensitive surface or layer.

In the case of processing stages where the reactions proceed to completion, such as, bleaching, fixing, bleach-fixing, washing and stabilising, increased agitation produces a reduction in processing times.

If the recirculation system for a particular processor is already adequate to mix up the processing solution and to maintain good uniformity of temperature and processing chemistry within that solution, another pump may be utilised to generate further agitation of the processing solution across the photosensitive surface or layer.

Advantageously, such a pump can be utilised to provide agitation of the processing solution towards the latter part of the processing path in the processing solution rather than providing the same agitation evenly across a larger area.

Alternatively, a single pump could be utilised to provide both the overall recirculation system for a particular processing stage and also additional localised agitation in accordance with the present invention, that is, providing agitation towards the latter part of the processing path in the processing stage.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
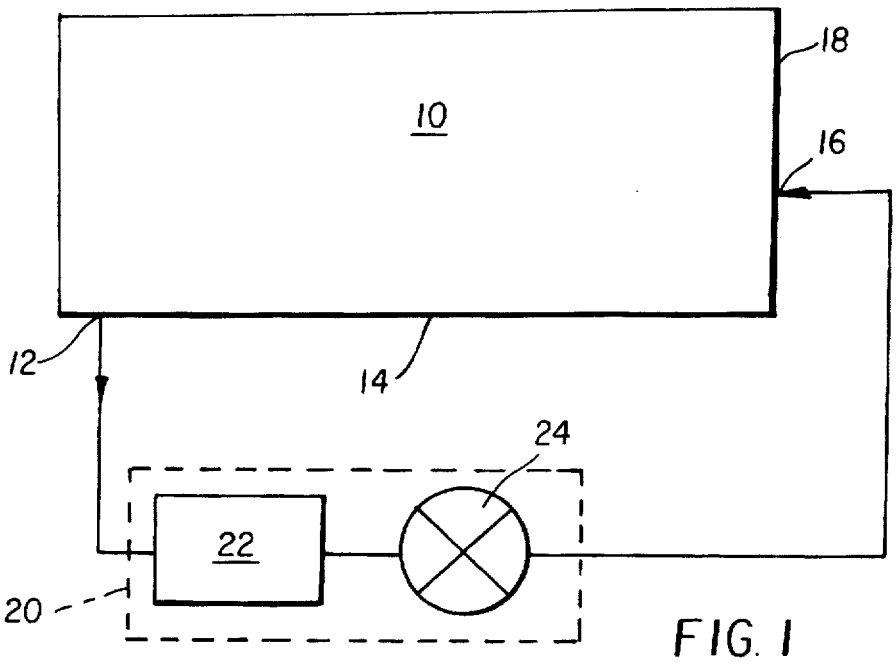
FIG. 1 is a schematic block diagram of a filtration system connected to a processing tank.

Referring initially to FIG. 1, a conventional processing tank 10 is schematically shown connected to a filtration system 20 which comprises a filter unit 22 and a pump 24. The tank 10 has an outlet port 12 located in bottom wall 14 and an inlet port 16 located in a side wall 18, outlet and inlet ports 12, 16 being connected to the recirculation system 20. Processing solution is removed from tank 10 via outlet port 12 and passes through filter unit 22 and pump 24 and is re-introduced into the processing tank at inlet port 16. Inlet port 16 may be located at any position in side wall 18.

Naturally, the filtration system 20 may also include a replenishment system (not shown) for replenishing consumable chemicals in the processing solution.

Figure 2:
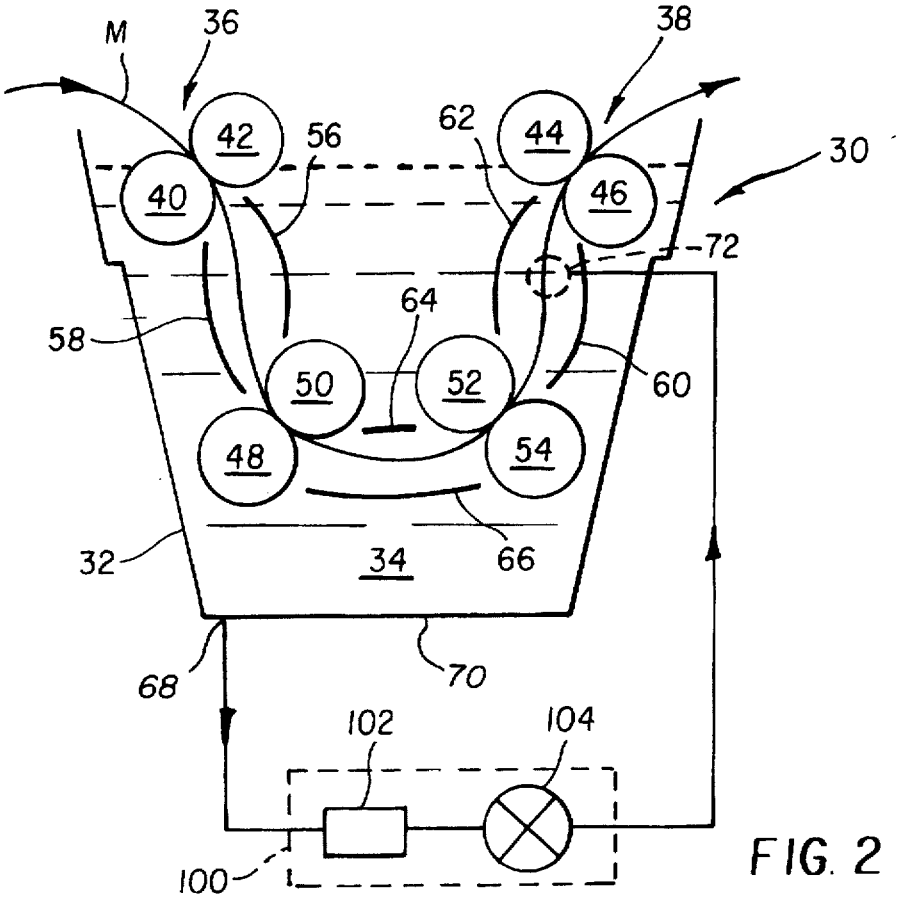
FIG. 2 is a schematic sectioned view of a processing tank in accordance with the present invention.

In accordance with the present invention, a fixing stage 30 of a processor is shown in FIG. 2. The fixing stage 30 comprises a processing tank 32 containing fixing solution 34 and having an inlet 36 and an outlet 38. Material M to be processed, indicated by the solid line, enters the tank 32 via inlet roller pair 40, 42 and exits from the tank 32 via outlet roller pair 44, 46. Inlet roller pair 40, 42 and outlet roller pair 44, 46 are driven rollers. Further drive roller pairs 48, 50 and 52, 54 are provided within tank 32.

A pair of guides 56, 58 are provided between inlet roller pair 40, 42 and drive roller pair 48, 50 to guide the material M through the fixing solution 34 from the inlet 36 to drive roller pair 48, 50. A pair of guides 60, 62 are provided between drive roller pair 52, 54 and outlet 38 to guide the material M through the fixing solution 34 from drive roller pair 52, 54 to outlet roller pair 44, 46. An additional pair of guides 64, 66 are also provided between drive roller pair 48, 50 and 52, 54.

A filtration system 100 is connected between an outlet port 68 is provided in bottom wall 70 of tank 32 and an inlet port 72 located in a side wall of tank 32 and aligned with guide pair 60, 62 in accordance with the present invention. As before, the filtration system 100 comprises a filter unit 102 and a pump 104 and is similar to filtration system 20 described with reference to FIG. 1.

In accordance with the present invention, inlet port 72 must be located in a position so that the filtered fixing solution can be directed at the material M when swell of the photosensitive surface or layer thereof has substantially stopped changing and when the reaction by-products are leaving the photosensitive surface or layer of the material.

Inlet port 72 may be connected to any suitable orifice (not shown) which injects the fixing solution back into the processing tank 32.

Recirculation of processing solution within a given processing tank can normally be effected by using a pump unit (not shown) which is submerged within the processing tank and which is effective to recirculate the processing solution wholly within that tank.

In a standard Glunz and Jensen ML550 processor which has a submerged pump arrangement for providing recirculation of a processing solution within a given processing stage, a separate pump for the filtration system as described above with reference to FIG. 2 was used in the fixing stage was used.

For rapid fixing, a key parameter to measure is the content of silver carried over in unexposed areas of the photographic material as it leaves the fixing stage after an exit squeegee. By measuring silver against submersion time for different methods of agitation, it is possible to determine the effectiveness of the agitation in terms of time.

In an experiment to measure the silver carry over, a silver/time curve was plotted. In both cases, the recirculation was pump on. The filter pump was also on but with the outlet from the processing tank at the bottom as normal but with inlet to the tank in one of two positions:

Case A) the inlet located on the bottom of the tank in the conventional position underneath the processing rack (not shown); and Case B) the inlet located in the side wall of the tank lined up with guide pair 60, 62 as shown in FIG. 2.

Test strips of an unexposed high contrast Graphic arts film material, KODAK "Imageset" 2000 Film ILD (KODAK and "Imageset" are trade marks of Eastman Kodak Company), width 459 mm with a coated silver weight of 3.3 g/m$^2$, were processed in a developer stage containing KODAK RA2000 Developer & Replenisher at 35° C. and then a fixing stage containing a seasoned fixer concentrate, as given below, diluted in the ratio 1 part of concentrate to 2 parts of water, at 35° C.

Fixer Concentrate (for 1 liter)

| Component | (g) |
|---|---|
| Acetic acid | 48.0 |
| Ammonium acetate | 90.9 |
| Ammonium thiosulphate | 535.0 |
| Ammonium sulphite | 48.0 |
| Water - demineralized | 521.0 |

The processing solutions had been previously seasoned by processing several hundred square meters of the above film which was unexposed. When fully seasoned, the silver level in the fixer was 17 g/l.

The fixing times were varied for the strips, at 1s intervals, for Case A) above. This was repeated for Case B).

Each film strip was removed from the processor after it had left the outlet roller pair 44, 46 of the fixing stage and left to dry in air. After drying, small samples were taken from three positions across the width of the film strip, namely, from the centre and from the two outer edges. The residual silver was measured for all three samples and a 'crossroll' average silver level was calculated. The values obtained were then plotted on a silver-time curve as shown in FIG. 3.

Figure 3:
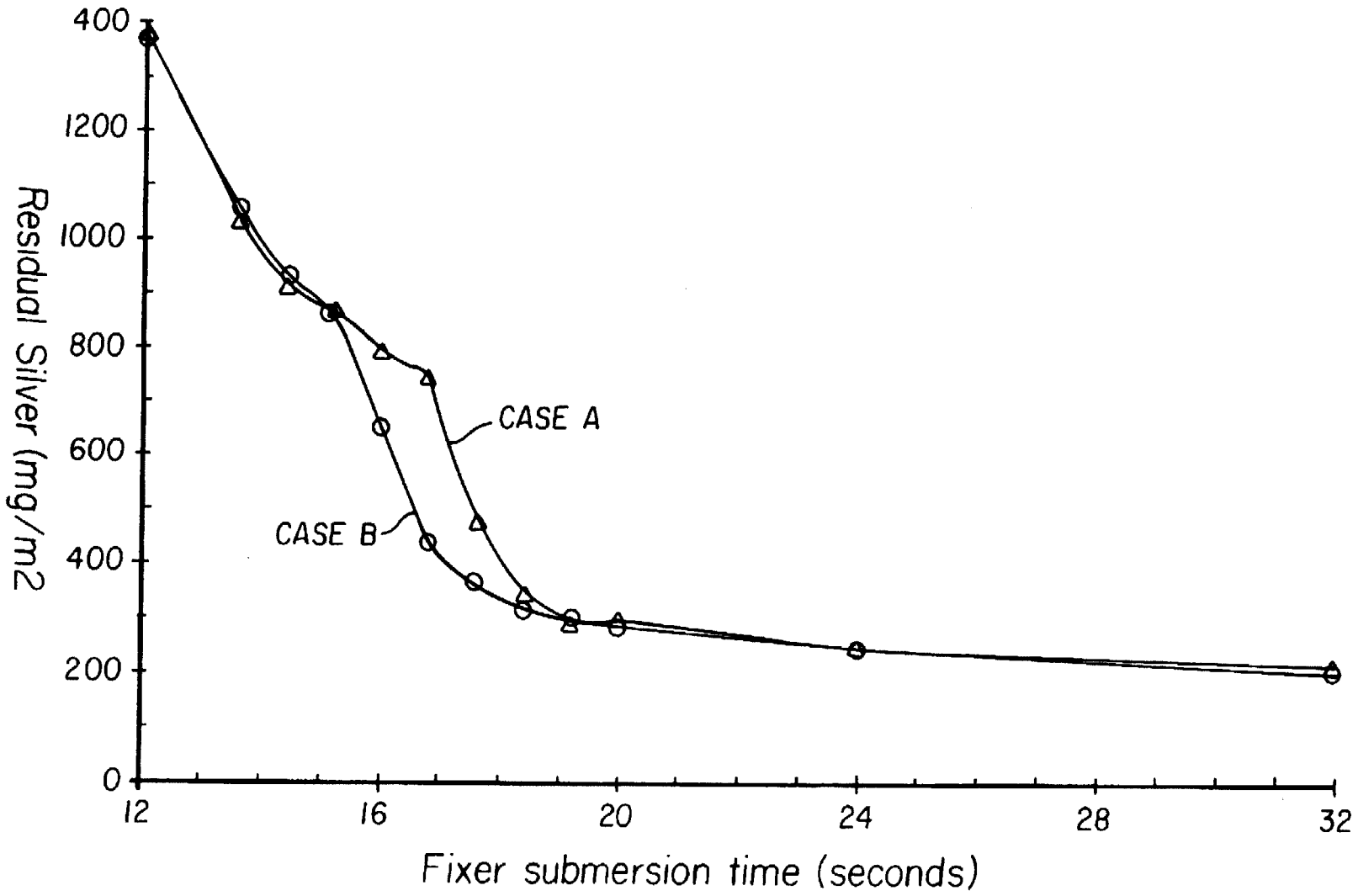
FIG. 3 is a graph showing the level of residual silver in photographic film as it leaves a fixing stage and illustrating the effect of the present invention.

From FIG. 3, it can be seen that there is less residual silver for fixing times in the range of 14s to 20s for Case B) than for Case A).

Although the operation of the present invention, has only been described with reference to the fixing stage of a photographic process, it will be readily appreciated that it is equally applicable to any processing stage where it is important to remove reaction by-products from the material being processed prior to entering a subsequent processing stage. This has the result of reducing the replenishment requirements for that subsequent processing stage.

The present invention can be utilised in any processing stage where the processing proceeds to completion, for example, the bleaching stage, bleach/fixing stage, the fixing stage and washing/stabilising stage, where increased agitation contributes towards faster processing times.

Parts List:

10 . . . processing tank
12 . . . outlet port
14 . . . bottom wall
16 . . . inlet port
18 . . . side wall
20 . . . filtration system
22 . . . filter unit
24 . . . pump
30 . . . fixing state

32 . . . processing tank
34 . . . fixing solution
36 . . . inlet
38 . . . outlet
40,42 . . . inlet roller pair
44,46 . . . outlet roller pair
48,50,52,54 . . . drive roller pairs
56,58 . . . guides
60,62 . . . guides
64,66 . . . guides
68 . . . outlet port
70 . . . bottom wall
72 . . . inlet port
100 . . . filtration system
102 . . . filter unit
104 . . . pump

I claim:

1. A method for processing photographic materials in an apparatus having at least two processing stages, said at least one processing stage comprising a processing tank having a processing path extending therethrough and an external filtration system connected thereto, the filtration system being connected between an outlet port and an inlet port provided in the processing tank, the inlet port being located at a position for directing processing solution within the last half of the processing path of a photographic material within the processing tank and at a direction which is generally transversed to the direction of movement and generally coplanar with respect to the photosensitive material being processed.

2. An apparatus for processing photosensitive materials in an apparatus having at least two processing stations, at least one processing stage comprising a processing tank having a processing path extending therethrough for processing a photosensitive material, and an external filtration system connected to the processing tank, the filtration system being connected between an outlet port and an inlet port, said inlet port being positioned for directing processing solution within the tank at a direction which is substantially transversed to the direction of movement and generally coplanar with the photosensitive material.

3. An apparatus according to claim 2, wherein a pair of guides are disposed on opposite sides of said photosensitive material and positioned in alignment with said inlet port for guiding processing solution therethrough.

* * * * *